United States Patent [19]

Sarcia

[11] 4,389,850

[45] Jun. 28, 1983

[54] HYBRID CRYOGENIC REFRIGERATOR

[75] Inventor: Domenico S. Sarcia, Carlisle, Mass.

[73] Assignee: CVI Incorporated, Columbus, Ohio

[21] Appl. No.: 369,862

[22] Filed: Apr. 19, 1982

[51] Int. Cl.[3] ..... F25B 9/00

[52] U.S. Cl. ..... 62/6; 60/520; 137/624.13; 137/625.35

[58] Field of Search ..... 62/6; 60/520; 137/624.13, 625.35

[56] References Cited

U.S. PATENT DOCUMENTS

| | | | |
|---|---|---|---|
| 2,966,035 | 12/1960 | Gifford | 62/6 |
| 3,188,818 | 6/1965 | Hogan | 62/6 |
| 3,188,821 | 6/1965 | Chellis | 62/6 |
| 3,218,815 | 11/1965 | Chellis et al. | 62/6 |
| 4,305,741 | 12/1981 | Sarcia | 62/6 |

*Primary Examiner*—Ronald C. Capossela

*Attorney, Agent, or Firm*—Seidel, Gonda, Goldhammer & Panitch

[57] ABSTRACT

The cryogenic refrigerator includes a movable displacer within an enclosure having first and second chambers of variable volume. A refrigerant fluid is circulated in a fluid path between said chambers by movement of the displacer. A spool valve controls introduction of high pressure fluid and low pressure fluid. The displacer movement, at least at top dead center and bottom dead center is controlled by an electric motor.

11 Claims, 2 Drawing Figures

HYBRID CRYOGENIC REFRIGERATOR

BACKGROUND

The present invention is an improvement on the Gifford-McMahon cycle. Familiarity with said cycle is assumed. Representative prior art patents teaching such cycle include U.S. Pat. Nos. 2,966,035; 3,188,818; 3,218,815; and 4,305,741.

For maximum efficiency and reliability, it is important to have maximum gas volume transfer through the regenerator. In order that this may be attained, it is important that the direction of gas flow be reversed when the displacer is at top dead center or bottom dead center. The present invention is directed to a solution of that problem by utilizing an electric motor to control the position of the displacer adjacent top dead center and bottom dead center in combination with pressure from an independent source and a slidable pressure responsive valve for controlling fluid flow.

SUMMARY OF THE INVENTION

The present invention is directed to a cryogenic refrigerator in which a movable displacer defines within an enclosure first and second chambers of variable volume. A refrigerant fluid is circulated in a fluid flow path between the first chamber and the second chamber by movement of the displacer. Movement of the displacer is controlled in part through the introduction of fluid at an intermediate pressure.

The refrigerator includes chamber means for guiding a slide having an axial passage. The slide is connected to the displacer. A motor is connected to the slide for controlling movement of the displacer at least at top dead center and bottom dead center positions thereof.

The passage in the slide has a restriction. A valve is provided with a spool valve member for controlling flow of the high and low pressure fluid. Means is provided including a conduit communicating one end of the spool valve member with the end of said chamber means remote from said displacer for introducing high fluid pressure into the conduit to shift the spool valve member when the displacer is at bottom dead center.

It is an object of the present invention to provide a cryogenic refrigerator wherein efficiency and reliability are improved by controlling movement of the displacer by the combination of a motor which controls the displacer at top dead center and bottom dead center positions but is overridden by fluid pressure at other positions of the displacer.

Other objects and advantages will appear hereinafter.

For the purpose of illustrating the invention, there is provided in the drawing a form which is presently preferred; it being understood, however, that this invention is not limited to the precise arrangements and instrementalities shown.

DETAILED DESCRIPTION

Figure 1:
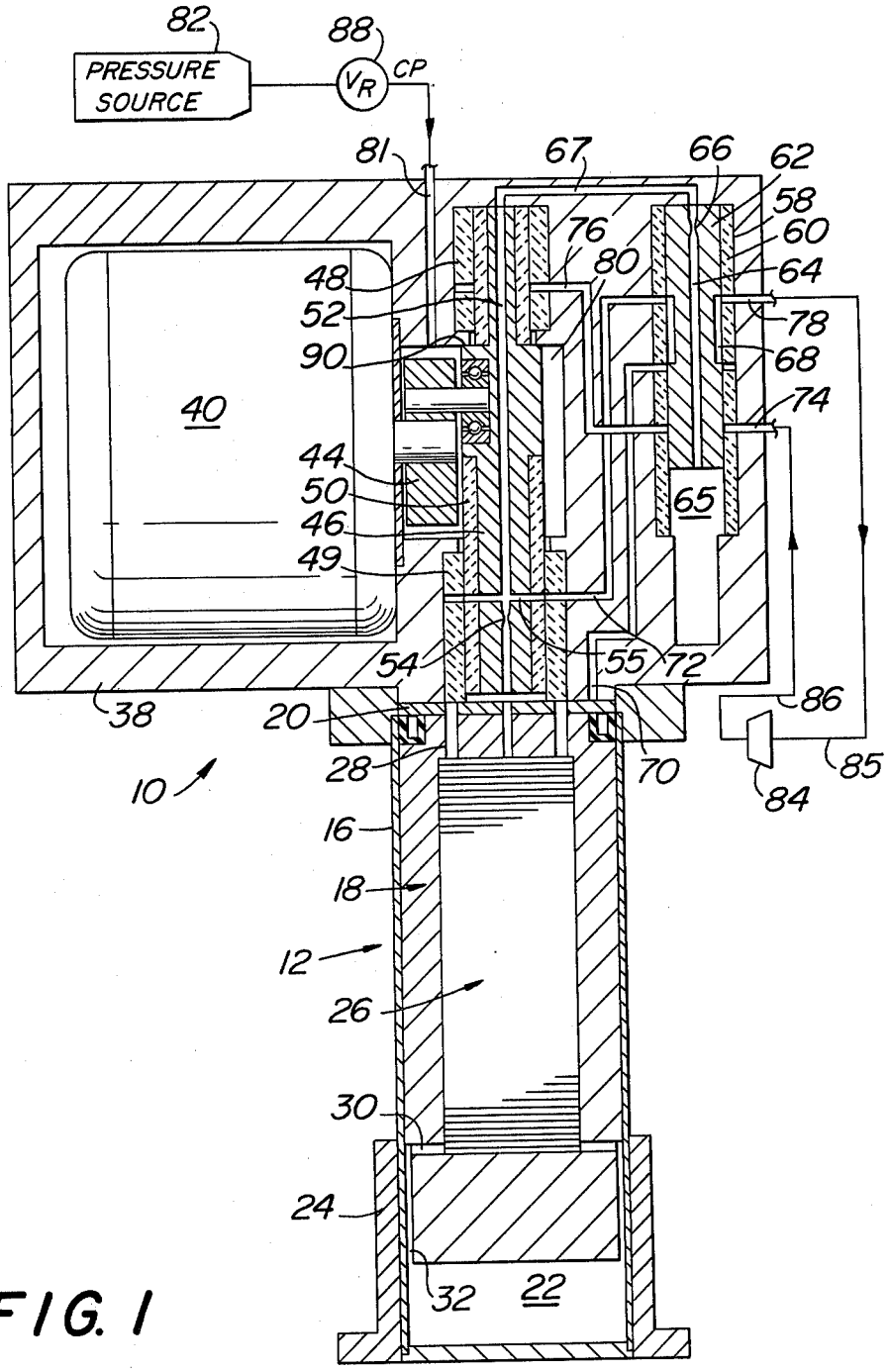
FIG. 1 is a vertical section view of a refrigerator in accordance with the present invention with the displacer at top dead center position.

Referring to the drawings in detail, wherein like numerals indicate like elements, there is shown a refrigerator in accordance with the present invention designated generally as 10. As illustrated, the refrigerator 10 has a first stage 12. When in use said stage 12 is disposed within a vacuum housing not shown. It is within the scope of the present invention to have one or more of such stages. Each stage includes a housing such as housing 16 within which is provided a displacer 18. The displacer 18 has a length less than the length of the housing 16 so as to define a warm chamber 20 thereabove and a cold chamber 32 therebelow. The designations warm and cold are relative as is well known to those skilled in the art.

A heat station 24 in the form of a tube having a flanged ring and made from a good heat conductive material is attached to the housing 16 and surrounds the cold chamber 22. Heat station 24 may have other constructions as is well known to those skilled in the art.

Within the displacer 18, there is provided a regenerator 26 containing a matrix. Ports 28 communicate the upper end of the matrix in regenerator 26 with the warm chamber 20. See FIG. 2. Radially disposed ports 30 communicate the lower end of the matrix in regenerator 26 with a clearance space 32 disposed between the outer periphery of the lower end of the displacer 18 and the inner periphery of the housing 16. Thus, the lower end of the matrix in regenerator 26 communicates with the cold chamber 22 by way of ports 30 and clearance 32. Clearance 32 is an annular gap heat exchanger.

The matrix of the regenerator 26 is preferably a stack of 250 mesh material having high specific heat such as oxygen free copper. The matrix has low void area and low pressure drop. The matrix is preferably copper but other materials such as lead, nylon, glass, etc. may be used.

A synchronous stepper motor 40 is disposed within a motor housing 38. Housing 16 depends downwardly from housing 38. The output of motor 40 is connected to a cam 44. Cam 44 has a follower disposed within a transverse slot of slide 46. Slide 46 is connected to the upper end of the displacer 18.

Figure 2:
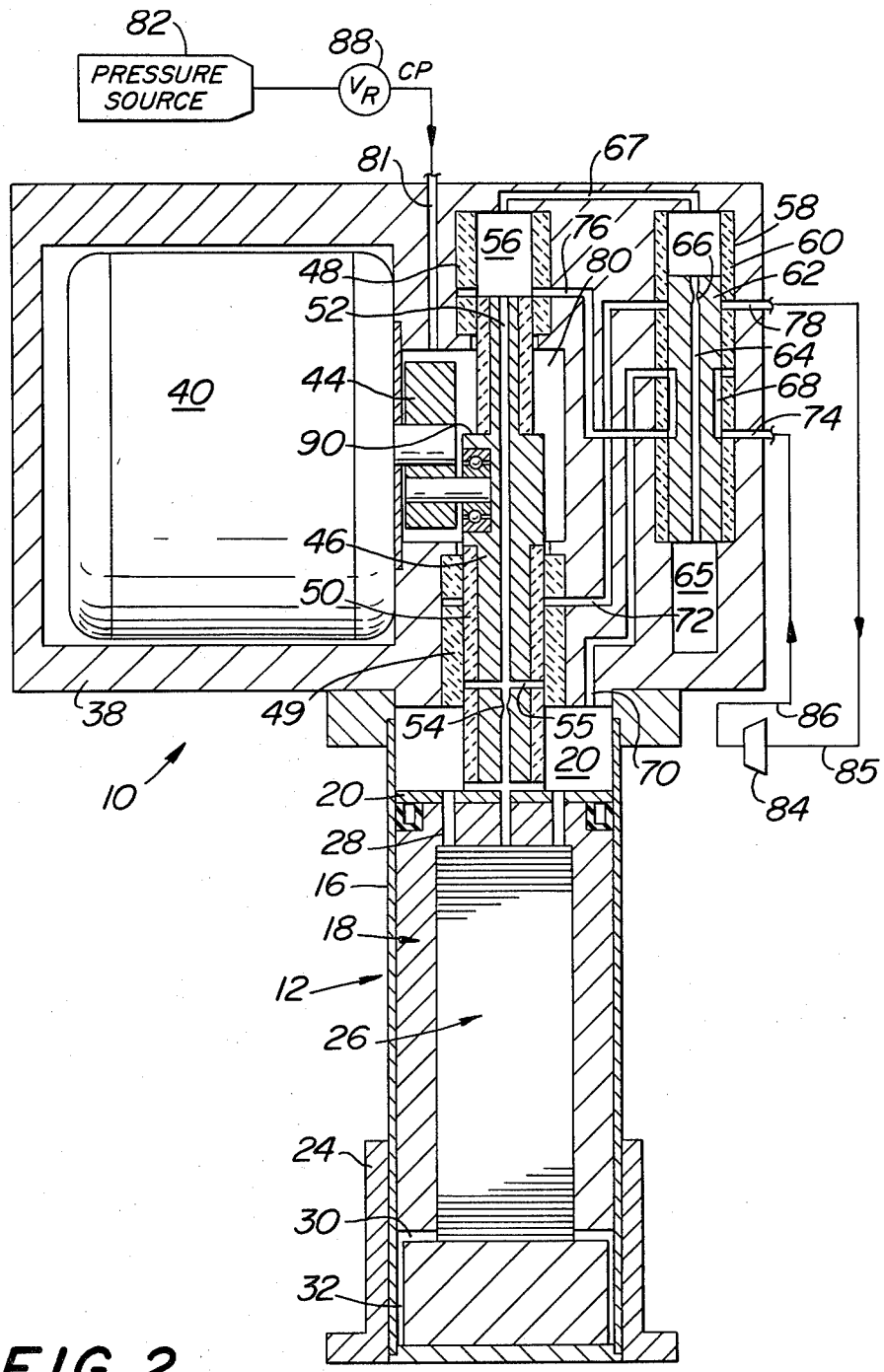
FIG. 2 is a view similar to FIG. 1 but showing the displacer as bottom dead center.

The slide 46 is surrounded by and guided by a clearance seal sleeve bearing 48 attached to the housing 38. Bearing 48 is preferably made from a ceramic material. Slide 46 has cylindrical bearing inserts 50 in sliding contact with the inner periphery of the clearance seal sleeve bearing 49. An axial flow passage 52 is provided in the slide 46. Slide 46 is longer than the sleeve bearing 48 and has radial ports 55 located above a restriction 54 in the passage 52. When the slide 46 is below top dead center, as shown in FIG. 2, the chamber means thereabove and within the bearing 48 is designated 56.

The housing 38 includes a bore 58 parallel to the slide 46. Within the bore 58 there is provided a clearance seal sleeve bearing 60 preferably made from a ceramic material. Within the sleeve bearing 60, there is provided a reciprocable spool valve member 62 having an axial flow passage 64. It will be noted that the member 62 has a length less than the length of the sleeve bearing 60 so that passage 64 communicates with chamber 65 therebelow.

Adjacent the upper end of member 62, there is provided a restriction 66 in passage 64. The upper end of the passage 64 communicates with chamber means 56 by way of conduit 67. A groove 68 is provided on the outer periphery of spool valve member 62. In the position of spool valve member 62 as shown in FIG. 1, one end of groove 68 communicates with the warm chamber 20 by way of passage 70. The other end of groove 68 communicates with the ports 55 by way of passage 72. A high pressure port 74 is provided in housing 38 and is blocked by the spool valve member 62 in the position thereof as shown in FIG. 1. As will be made clear hereinafter, port 74 is adapted to communicate with chamber means 56 by way of passage 76 when the displacer 18 is at bottom dead center.

In the position of the spool valve member 62 as shown in FIG. 1, the upper end of the groove 68 communicates with a port 78 which communicates directly with the suction side of a compressor 84 via conduit 85. The output from compressor 84 communicates by way of conduit 86 with the high pressure port 74.

A chamber 80 surrounds part of the slide 46. Chamber 80 communicates with passage 81 which is connected to the pressure source 82 by a constant outlet pressure regulator valve 88. Valve 88 is set at a pressure intermediate the high and low pressures associated with ports 74 and 78. The upper end portion of slide 46 is of reduced diameter so as to define shoulder 90 which is a fluid reaction surface. Chamber 80 is isolated from chamber 56 by the clearance seal between slide 46 and bearing 48.

The housing 38 is constructed of a number of components so as to facilitate machining of the housing, assembly, and access to the spool valve member 62 and slide 46. The manner in which housing 38 is comprised of a plurality of components is not illustrated but will be obvious to those skilled in the art. The refrigerator 10 is preferably designed for use with a cryogenic fluid such as helium but other fluids such as air and nitrogen may be used. The refrigerator 10 was designed to have a wattage output of at least 65 watts at 77° K. from stage 12 and a minimum of 5 watts at 20° K. at stage 14.

The length of the stroke of the movable members is short such as 12 mm for valve member 62 and 30 mm for displacer 18. Valve member 62 need not have axial flow passage 64 but instead may be a solid spool valve member which responds to differential pressure.

OPERATION

As shown in FIG. 1, the displacer 18 is at top dead center and under the control of the motor 40. Spool valve member 62 has just moved to its uppermost position wherein chamber 20 communicates with the suction side of compressor 84 by way of passage 70, port 78, and conduit 85. The chamber 65 below spool valve member 62 is also exhausted by way of passage 64, conduit 67, and passages 52, 72. Gas at an intermediate pressure is trapped in chamber 80.

As the displacer begins to move downwardly by motor 40, the cold low pressure gas in chambers 22, 34 moves upwardly through the regenerator 26 and is exhausted. Gas in chamber 80 acts on shoulder 90 and pushes the slide 46 downwardly thereby overriding motor 40. As the gas moves up through the regenerator, it absorbs heat from the regenerator 26 thereby cooling the regenerator. As the slide 46 is moving down it approaches passage 76. When the upper end of slide 46 uncovers passage 76, the displacer 18 will be at bottom dead center as shown in FIG. 2. Accuracy in locating the passage 76 directly effect efficiency. High pressure from port 74 now flows from passage 76 to chamber means 56 and conduit 67. The pressure between restrictors 54 and 66 increases. When the high pressure gas overcomes the low pressure fluid trapped in chamber 65, member 62 descends to the position shown in FIG. 2. Now the entire system contains high pressure gas except for passage 72 which is blocked at both ends. The displacer 18 is at bottom dead center.

The function of the regenerator 18 is to cool the gas passing downwardly therethrough and to heat gas passing upwardly therethrough. In passage downwardly through the regenerator, the gas is cooled thereby causing the pressure to decrease and further gas to enter the system to maintain the maximum cycle pressure. The decrease in temperature of the gas in the chamber 22 is useful refrigeration which is sought to be attained by the appartus. As the gas flows upwardly through the regenerator, it is heated by the matrix to near ambient temperature thereby cooling the matrix.

The side 46 is moved upwardly with the displacer 18 by motor 40 as high pressure gas moves downwardly into chambers 20 and 34. Port 55 aligns with passage 72 just before top dead center is reached. This immediately places passage 52 and conduit 67 in communication with the suction side of the compressor 84. The high pressure gas trapped in chamber 65 below the spool valve member 62 raises the spool valve member from the position shown in FIG. 2 to the position shown in FIG. 1 as the displacers reach top dead center. One cycle is now complete.

The manner in which fluid pressure overrides the control of slide 46 and displacer 18 is as follows. The vertical force on the crank arm on cam 44 is the tangential force divided by the sine of the crank angle. Assume a tangential force of 10 pounds, a high pressure gas of 300 psi, a low pressure gas of 100 psi, a pressure for source 82 of 200 psi, and a differential area of shoulder 90 of 0.4 square inches. Motor 40 will be the sole control of slide 46 at the zone defined by 15° before and 15° after each of top dead center and bottom dead center where torque is at a maximum. When the crank arm moves 15° from top dead center and slide 46 has moved downwardly, the force on shoulder 90 is 40 pounds ($200-100\times0.4$ inches square). The vertical force of motor 40 on slide 46 at 15° below top dead center is 10 divided by 0.25 which equals 40 lbs. Between 15° and 165° below top dead center the pressure on shoulder 90 exceeds the vertical force of the motor 40.

Thus, the fluid pressure force on shoulder 90 overrides the force of the motor 40 and causes it to speedup during approximately 300° of one complete cycle. The same differential pressure conditions exist when the slide is moving upwardly since the delta P will also be 100 psi (300–200). Hence, motor 40 can be much smaller and less expensive than that which would be required without the intermediate pressure and the reaction surface of shoulder 90.

The present invention may be embodied in other specific forms without departing from the spirit or essential attributes thereof and, accordingly, reference should be made to the appended claims, rather than to the foregoing specification, as indicating the scope of the invention.

I claim:

1. In a cryogenic refrigerator in which a movable displacer means defines within an enclosure first and second chambers of variable volume, and in which a refrigerant fluid is circulated in a fluid flow path between said first chamber and said second chamber by the movement of said displacer means controlled in part through the introduction of high-pressure fluid and the discharge of low-pressure fluid, the improvement comprising chamber means for guiding a slide connected to the displacer means, said slide having an axial passage communicating with one end of said chamber means remote from the displacer means, a motor coupled to said slide for controlling movement of the displacer means adjacent top dead center and bottom dead center positions thereof, a fluid reaction surface on said slide intermediate its ends, means for applying pressure to said surface for overriding said motor when the slide is spaced from top dead center, said passage in said slide having a restriction, a valve having a spool valve member for controlling flow of the high and low pressure fluid, means including a conduit communicating one end of said spool valve member with said one end of said chamber means for introducing high fluid pressure into the conduit to shift the spool valve member when the displacer means is at one of the extremities of its movement.

2. Apparatus in accordance with claim 1 wherein said last mentioned means is arranged to shift the spool valve member when the displacer means is at bottom dead center.

3. Apparatus in accordance with claim 1 wherein said last mentioned means is arranged to shift the spool valve member when the displacer means is at top dead center.

4. Apparatus in accordance with claim 1 wherein said reaction surface is defined by a reduced diameter portion of said slide at the upper end thereof.

5. Apparatus in accordance with claim 1 wherein said spool valve member has an axial passage containing a restriction therein adjacent the end thereof communicating with the conduit.

6. Apparatus in accordance with claim 1 wherein a source intermediate pressure fluid is in communication with a chamber exposed to said reaction surface.

7. Apparatus in accordance with claim 1 including a ceramic clearance seal sleeve bearing for said slide and spool valve member.

8. Apparatus in accordance with claim 1 including passage means for venting said passage in each of said slide and said conduit as the displacer means approaches top dead center to thereby enable the spool valve member to reverse its positions with respect to high and low pressure.

9. Apparatus in accordance with claim 1 wherein said means for applying pressure to said reaction surface is a source of gas at pressure between the high and low pressure fluids.

10. Apparatus in accordance with claim 9 wherein said slide and displacer are controlled solely by said motor in the zones about 15° before and after top dead center and bottom dead center.

11. In a cryogenic refrigerator comprising a movable displacer means within an enclosure having first and second chambers of variable volume, and in which a refrigerant fluid is circulated in a fluid flow path between said first chamber and said second chamber by the movement of said displacer means controlled in part through the introduction of high-pressure fluid and the discharge of low-pressure fluid, chamber means for guiding a slide connected at one end to the displacer means, said slide having an axial passage communicating one of said chambers with one end of said chamber means remote from the displacer means, a motor coupled to said slide for controlling movement of the displacer means adjacent top dead center and bottom dead center positions thereof, a fluid reaction surface on said slide intermediate its ends, means for applying an intermediate pressure to said surface for overriding said motor, a valve for controlling flow of the high and low pressure fluid, and means to shift the valve when the displacer means is at one of the extremities of its movement.

* * * * *